US006973879B1

(12) United States Patent
McElroy et al.

(10) Patent No.: US 6,973,879 B1
(45) Date of Patent: Dec. 13, 2005

(54) MONOLITHIC HIGH INCAPACITATION SMALL ARMS PROJECTILE

(76) Inventors: Hugh Anthony McElroy, 7227 Alafia Ridge Loop, Riverview, FL (US) 33569; Michael Ray Harris, 2210 Whitlock Pl., Dover, FL (US) 33527

( * ) Notice: Subject to any disclaimer, the term of this patent is extended or adjusted under 35 U.S.C. 154(b) by 57 days.

(21) Appl. No.: 10/389,470

(22) Filed: Mar. 14, 2003

Related U.S. Application Data

(60) Provisional application No. 60/364,666, filed on Mar. 16, 2002.

(51) Int. Cl.[7] ..... F42B 12/04; F42B 12/74; F42B 12/76; F42B 30/02

(52) U.S. Cl. ..... 102/514; 102/501

(58) Field of Search ..... 102/501, 514–517, 102/511

(56) References Cited

U.S. PATENT DOCUMENTS

| | | | | | |
|---|---|---|---|---|---|
| 740,914 | A | | 10/1903 | Platz | |
| 807,375 | A | | 12/1905 | Haase | |
| 1,072,880 | A | | 9/1913 | Tewes | |
| 1,398,229 | A | | 11/1921 | Hadfield et al. | |
| 1,777,519 | A | * | 10/1930 | Flowers | 102/436 |
| 1,916,465 | A | | 7/1933 | Dawson | |
| 2,120,913 | A | | 6/1938 | Studler | |
| 2,303,449 | A | | 12/1942 | Fleischmann | |
| 2,336,143 | A | | 12/1943 | Werme | |
| 2,346,462 | A | * | 4/1944 | Southwell et al. | 86/54 |
| 2,379,701 | A | * | 7/1945 | Friedman | 86/54 |
| 3,154,016 | A | | 10/1964 | Frey | |
| 3,401,637 | A | * | 9/1968 | Briscoe | 102/501 |
| 3,431,612 | A | | 3/1969 | Darigo et al. | |
| 3,442,216 | A | | 5/1969 | Six et al. | |
| 4,109,581 | A | | 8/1978 | Six | |
| 4,338,862 | A | | 7/1982 | Kwatnoski et al. | |
| 4,619,203 | A | | 10/1986 | Habbe | |
| H279 | H | * | 6/1987 | Roecker | 73/167 |
| 4,811,666 | A | * | 3/1989 | Lutfy | 102/501 |
| 4,878,434 | A | * | 11/1989 | Sommet | 102/514 |
| 5,009,166 | A | | 4/1991 | Bilsbury et al. | |
| 5,012,743 | A | | 5/1991 | Denis et al. | |
| 5,597,975 | A | | 1/1997 | Satow | |
| 5,686,693 | A | | 11/1997 | Jakobsson | |
| 6,085,661 | A | | 7/2000 | Halverson et al. | |
| 6,158,351 | A | | 12/2000 | Mravic et al. | |
| 6,286,433 | B1 | | 9/2001 | Borg et al. | |
| 6,374,743 | B1 | | 4/2002 | Hug et al. | |

OTHER PUBLICATIONS

Martin L. Fackler, MD; Wound Profiles; International Wound Ballistics Review vol. 5 Nr 2 Fall 200). pp. 25-38; El Segundo, CA 90245.

Gary K Roberts. DDS; The Wounding Effects of 5.56 mm/.223 Law Enforcement General Purpose Shoulder Fired Carbine Compared with 124n. Shotguns and Pistol Caliber Weapons Using 10% Ordance Gelatin as a Tissue Simulant; International Wound Gallistics Association, Wound 2 Ballistics Review vol. 3, Nov. 4, 1998 pp. 16-28; El Segundo, CA 90245.

1,) M4_ID-BOP-CD-100-1 (At 100 Meters) 2,) 5.56 mn Ball Multi-Purpose From M4 with 10.59 Barrel at 200 Meters.

* cited by examiner

*Primary Examiner*—Michael J. Carone
*Assistant Examiner*—James S. Bergin

(57) ABSTRACT

A small arms projectile for an increase in accuracy, incapacitation effects, and penetration of light material targets. The projectile includes a monolithic heat-treated steel core with a plated on jacket for strong adherence. A swaged or machined cannelure groove to provide a secure interface with conventional cartridge cases, support operation in semi-automatic and full automatic firearms, and a consistent shot start is also provided. An aero-ballistic efficient nose for increasing the projectile's ballistic coefficient and dynamically adapting to soft and hard targets and light material in a novel manner is also provided.

1 Claim, 1 Drawing Sheet

Monolithic High Incapacitation Small Arms Projectile

Prior Art M855 Projectile

Monolithic High Incapacitation Small Arms Projectile

MONOLITHIC HIGH INCAPACITATION SMALL ARMS PROJECTILE

CROSS-REFERENCE TO RELATED APPLICATION

This application claims benefit of Provisional Patent Application, application No. 60/364,666 filed Mar. 16, 2002.

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to a small arms projectiles and more specifically it relates to a monolithic high incapacitation multipurpose small arms projectiles for an increase in the level of incapacitation in soft targets, a high level of accuracy, and significant target effects against light armor or light material targets while remaining non-polluting.

2. Prior Art

It can be appreciated that high velocity small arms projectiles have been in use for many years. Typically, small arms projectiles are comprised of projectiles such as the 5.56×45 mm NATO M855 ball projectile both lead containing and lead free, but made up of in the case of the M855, three separate parts all separately fabricated and ultimately assembled into a composite projectile structure. Other common high velocity projectiles are only made up of two parts, the jacket and a lead core, as exemplified by the military M193 ball projectile that is now obsolete.

The main problem with conventional small arms projectiles are such as the 5.56 mm M855 projectile is that the fabrication accuracy requirements and controls are relatively tight for each of the individual parts (about ½ the tolerance levels of the two part projectiles such as the M193) as well as for the total assembly. Additionally due to the multicomponent construction the projectile will generally breakup upon striking either hard or soft targets due to the intrinsic weakness of the gilding metal jacket surrounding both the penetrator and soft rear core, usually constructed of either lead antimony alloy or as of late a tungsten-tin or tungsten-nylon composite of the same density as the older lead based core.

In addition to the tendency of the M855 and the M193 projectiles to breakup at short ranges upon entry into the target such projectiles have limited lethality or incapacitation effects at longer ranges due to the high Sg or gyroscopic stability factor as a result of the mass moments of inertia of the high-density core filler material and the low length to diameter ratio. Projectiles such as the M855 or the M193 if they do not break up upon entry into the target as represented by 10% Ordnance gelatin they will typically turn over once (yaw 180 degrees) and continue to move through the target base first. Thus the total volume of crushed gelatin (a tissue simulant) will be proportional to the presented area of the projectile as it traverses the target. The majority of the crush track area is therefore proportional to the frontal area of the projectile, whether moving front first or base first, with the exception of the short distance where the projectile is actually turning over (yawing) where the presented area is significantly larger. Another problem with conventional small arms projectile are the less than desirable terminal ballistics effects (incapacitation) against soft targets especially when launched at lower velocities from the 14.5 in and 10.5 in barreled carbines in the case of the 5.56×45 mm NATO M855 ball ammunition.

Another problem with the conventional small arms projectiles are that in the case of the M855 and M193 ball projectiles is that they tend to break up upon striking automobile windshield glass, auto door panels and other light materials such as heavy brush and vegetation causing a significantly diminished incapacitation effect to targets behind such barriers or secondary targets.

While these older ball projectiles such as the 5.56×45 mm M855 and M193 may be suitable for the particular purpose to which they address, they are not as suitable for the particular purpose to which they address as the present invention in the areas of incapacitation, hard target and light material effects and accuracy of small arms projectiles and ammunition.

OBJECTS AND ADVANTAGES

A primary object of the present invention is to provide a monolithic high incapacitation small arms projectile that will overcome the shortcomings of the prior art projectiles.

An object of the present invention is to provide said monolithic high incapacitation small arms projectile for an increase in the incapacitation of small arms projectiles and ammunition by yawing only 90 degrees upon entry into soft tissue targets and remaining in that orientation (yaw of repose) throughout it's penetration while describing a helical path and the resultant wound track is therefore proportionately larger by a factor of four or more, depending upon the length of the projectile and the resultant wound track. This lethality mechanism is reliability active at all ranges from 0 meters out to 600 to 800 meters and possibly more depending upon the initial muzzle velocity and the resultant spin rate of the projectile.

Another object is to provide said monolithic high incapacitation small arms projectile that has enhanced lethality at all ranges against soft tissue as well as hard or secondary targets as compared to the current M855 NATO 5.56×45 mm ball ammunition.

Another object is to provide said monolithic high incapacitation small arms projectile that provides an environmentally friendly projectile made of medium carbon steel with a jacket from the group consisting of Copper, Nickel, Zinc and Aluminum or their alloys.

Another object is to provide said monolithic high incapacitation small arms projectile that has improved intrinsic accuracy and ballistic flight characteristics due to the monolithic design features and chosen optimal aero-ballistic shape.

Another object is to provide said monolithic high incapacitation small arms projectile that has a length to diameter ratio of between 4.5 and 5.0 due to the chosen optimal aero-ballistic shape and the resultant desired dynamic stability factor which controls the yaw and subsequent motions upon entry into a soft tissue or tissue simulant target.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

In these respects, said monolithic high lethality small arms projectile according to the present invention substantially departs from the conventional functional concepts and designs of the prior art, and in so doing provides a unique projectile and related unique projectile effects primarily developed for the purpose of an increase in the incapacitation effects, light and hard target effects and accuracy of small arms ammunition particularly well suited for military use while reducing the lead pollution on firing ranges.

Prior art in military rifle projectiles up to the Spanish American war were based on the effectiveness of large diameter (0.45 in–0.68 in) soft lead bullets, which made a correspondingly large hole in the target. While the large crush or wound cavity was extremely lethal, the large heavy bullets require a heavy firearm with a great deal of recoil, heavy ammunition that limited the amount of ammunition carried, and the low velocity and high drag produced high arcing trajectory that complicated marksmanship.

The invention of smokeless powder and smaller (0.264 in–0.311 in) jacketed lead core projectiles allowed lighter weapons and ammunition with greater range, penetration, flatter trajectories and less recoil proceeded up through the Korean War. The smaller projectiles had less drag in the air, but made smaller wound crush cavities. Early attempts to restore the size of the permanent wound cavity lead to the development of soft point or hollow point expanding jacketed lead core bullets. This art was outlawed under the Law of Land Warfare and continues in use only in civilian hunting and law enforcement ammunition. Increasing the soldier's ammunition load and rate of fire has dominated military doctrine to the present and lead to almost universal adoption of the assault rifle. Assault rifles use reduced velocity medium caliber rounds of conventional design or small caliber high velocity rounds. The US Army developed the 5.56 mm 55 grain Ball M193 projectile, which was designed to tumble when striking the target. The use in combat demonstrated close range lethality was based on the bullet fragmenting to produce a large permanent wound cavity. However, it was inadequate at penetrating cover or light protective materials because the bullet readily broke up at short ranges and at ranges beyond 200 meters it lacked penetration and lethality. The low weight, low recoil, flat trajectory, high rate of fire, small caliber high velocity assault rifles are the state of current art as represented by the NATO M855 5.56×45 mm, Russian 5.45 mm and Chinese 5.8 mm projectiles.

The 5.56×45 mm NATO M855, 62 grain projectile, was designed to penetrate a helmet at 800 meters. It penetrates 3.5 mm NATO steel target at 560 meters. Our research shows that the M855 jacket is too weak to hold the mass of the lead core behind the steel tip especially when striking targets at high obliquities. Impacts at even a few degrees of obliquity or yaw causes the jacket to break-up and the tip separates from the core fragmenting the bullet with the attendant severe loss of both penetration and lethality. When the M855 is fired at even civilian vehicles doors and windows the fragmented bullet fails to provide enough penetration and causality producing effects to reliably incapacitate the vehicle or its occupants. During the several embassy attacks and at the Marine barracks in Lebanon, terrorist truck bombs were ineffectually engaged with small arms as the terrorist approached their targets.

At the closer ranges the M855 enters the human target about five inches, yaws approximately 90 degrees and then breaks up into fragments. This results in a relatively large crush cavity and is the main source of the M855's effectiveness at incapacitation. However, the M855 nor the M193 is not consistent in the depth at which it yaws and breaks up, in some cases it breaks up too early and in other cases it breaks up too late for effective incapacitation. At longer ranges the M855 often simply creates a small .22 caliber wound track, makes one 180 degree yaw and exits backwards with little tissue disruption. The present invention immediately yaws 90 degrees, remains side ways, and cuts a deep helical wound track. The present invention in 5.56 mm produces a 400–500% increase in the volume of the permanent wound cavity compared to M855 based on the FBI method that uses the cross sectional area and depth of penetration. The 5.45×39 mm Russian yaws quicker than the M855 and yaws 180 degrees (or tumbles) twice. The present invention has a 350–450% advantage over the 5.45 mm Russian.

The close range lethality from the 5.56 mm M855 family of projectiles is based upon the jacket failing which adversely affects penetration. This sheet metal jacket multi-component core design contributes to the lack of penetration through brush and light building materials. Most of the ammunition expended in a firefight is fired for suppression and not at visible point targets. Suppressive fires degrade the enemy's ability to fire or maneuver effectively reducing friendly casualties. M855 projectiles tend to breakup on vegetation or other light cover and loose their ability to continue on to find the enemy. This is a major operational shortcoming of the M16A2/M4 rifles and the M249 Squad Automatic Weapon (SAW). The SAW's primary role is to suppress but the current ammunition limits the effectiveness. The universal basic combat doctrine of fire and maneuver depends on the effectiveness of suppressive fires to allow maneuver without sustaining excessive casualties. The M855 limited penetration of light cover and protective materials and decreased lethality beyond 200 meters seriously reduces the effectiveness of suppressive fires. The present invention provides significantly greater penetration, lethality, and substantially increases the range and effectiveness of suppressive fires.

The Army has recently adopted lead free M855 ammunition for both training and operations, however it's construction is almost identical with the earlier M855 with the exception of a powdered tungsten plus a soft matrix (tin or nylon) core giving the projectile the same weight, center of gravity and mass moments of inertia, thus the reaction, range, penetration and breakup of this projectile is almost identical to the older M855 containing lead. No improvements in performance were achieved with the adoption of the lead free M855 ammunition over the older lead containing M855 rounds except that it is lead free and non-polluting. It should also be noted that the powdered tungsten for this ammunition comes primarily from overseas. Due to the tungsten content, the lead free M855 projectile is expected to cost about two or more times as much as the older lead containing M855 projectile, even in high production rate quantities.

The Army's enhanced 5.56 mm Armor Piercing program has been focused on the adoption of the M995 5.56 mm AP round (projectile made by FFV-Bofors in Sweden) that uses a tungsten heavy metal cored jacketed projectile that penetrates the 3.5 mm NATO steel target at 750 meters, cinder blocks at 50 meters, 12.7 mm RHA at 175 meters, and 12.7 mm aluminum armor at 450 meters. This ammunition is also expected to cost more than two times the old M855 ammunition and is expected to be a limited issue round as compared to the ball projectile disclosed herein. Furthermore, this projectile still contains a significant amount of lead.

The effectiveness of military small arms projectiles is based on:

The mass and velocity of the projectile contributes effectiveness and is proportional to Mass×Velocity$^{1.5}$ rather than kinetic energy or simple momentum. Effectiveness of equal weight projectiles is enhanced by projectile designs that achieve higher velocities and retain velocity at longer ranges due to higher ballistic coefficients. Such projectiles have more force to apply to the target.

An accuracy of 2.5–3 minutes of angle (MOA) is all that is required to enhance the probability of hit and enable a skilled marksman to direct hits to the most vital areas significantly increasing probability of rapid incapacitation.

The volume of the permanent wound or crush cavity and the depth of penetration are the primary measures of lethal effectiveness.

Higher velocity projectiles have shorter time of flight and are less sensitive to range estimation errors, wind drift, and moving targets in the ballistic aiming solution.

SUMMARY

In view of the foregoing disadvantages inherent in the known types of small arms projectiles now present in the prior art, in the present invention provides said new monolithic high incapacitation small arms projectile construction wherein the same can be utilized for an increase in the incapacitation, defeat of light material and armor and accuracy of small arms projectiles and ammunition.

The general purpose of the present invention, which will be described subsequently in greater detail, is to provide said new monolithic high incapacitation small arms projectile that has many of the advantages of the small arms projectile mentioned heretofore and many novel features and more particularly novel and unexpected functions that result in the new monolithic high incapacitation small arms projectile which is not anticipated, rendered obvious, suggested, or even implied by any of the prior art small arms projectile, either alone or in any combination thereof.

To attain this, the present invention generally comprises a specially heat treated steel core of the shape of the projectile, with a plated on surface of a rifling engagement means which is strongly bonded to the core through a plating means. This engagement surface or bonded jacket can be of a metallic material or alloy from a class such as copper, nickel, zinc, or aluminum and their alloys. The acceptable plating or bonding processes can be electroplating, electroless plating or mechanical plating as is desired to achieve the best function and economy for the chosen material or alloy. The basic steel or other suitable material core is fabricated to the shape and dimensions of the desired projectile less the jacket thickness using conventional means. The jacket or engravement surface is typically made of copper, nickel, zinc or aluminum and alloys of each that can be accurately plated on the surface of the preferably medium carbon alloy steel core.

There has thus been outlined, rather broadly, the more important features of the invention in order that the detailed description thereof may be better understood, and in additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also it is to be understood that the phraseology and terminology employed herein are for the purpose of the description and should not be regarded as limiting.

DRAWINGS—FIGURES

DETAILED DESCRIPTION—FIG. 2—PREFERRED EMBODIMENT

Figure 1:
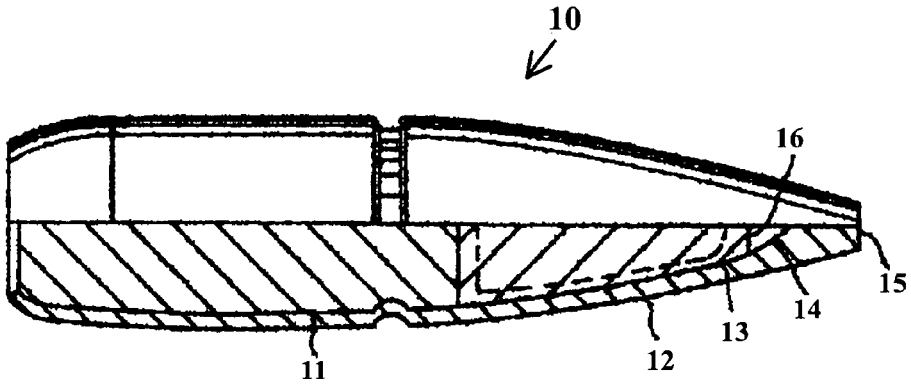
FIG. 1 is an example of prior art showing a longitudinal section of the projectile known as the M855 5.56×45 mm NATO ball projectile, 10.
Figure 2:
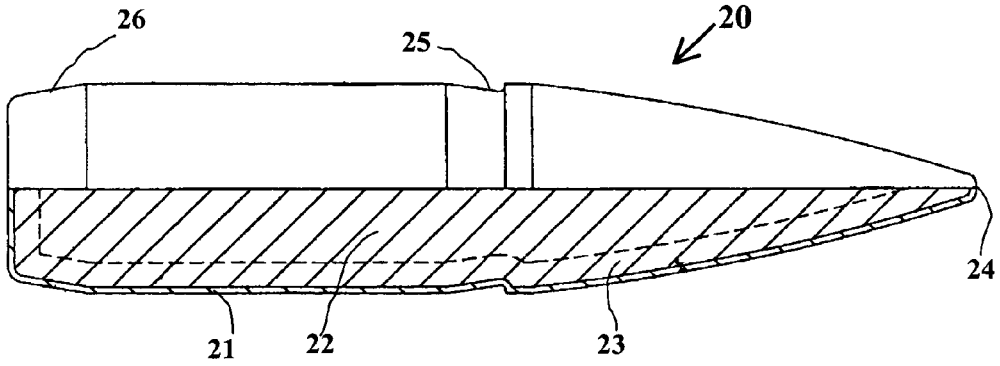
FIG. 2 is a view showing a longitudinal section of the projectile of this invention, 20

Turning now descriptively to the drawings, in which similar reference characters denote similar elements throughout the several views, the attached figures illustrate both a prior art projectile such as the NATO 5.56×45 mm M855 referenced as FIG. 1, projectile 10 and the current invention FIG. 2, projectile 20.

It is seen that projectile 10 includes a lead or tungsten-tin/tungsten-nylon body 11 located behind a frustroconical steel insert or penetrator 13 which has a secant ogival exterior surface and a flat front end 16. Body 11 and insert 13 are encased within a gilding medal jacket 12 which has a relatively blunted tip 15 defining a conical air pocket 14 immediately in front of insert 13 inside of jacket 12. The flat front end of the steel insert 13 is supposed to allow projectile 10 to penetrate armor at greater obliquity than would be the case if steel insert 13 had a pointed nose because it is taught in U.S. Pat. No. 4,619,203 that a pointed nose would tend to be deflected and the insert 13 as designed can dig into the surface of a metallic target.

Steel insert 13 of projectile 10 is additionally surface or case hardened to a minimum of Rockwell C50 to a depth of 0.030 inches in order to give the insert 13 increased hardness relative to the armor plates against which it would be expected to be used. There is strong belief found throughout the prior art, that hardening the nose of the projectile is a bad thing to do because it increases the brittleness of the nose portion which portion sees the highest impact forces as the projectile strikes the target (see for example U.S. Pat. No. 1,398,229) thus the basic thrust of the prior art has been to soften the nose portion relative to the remainder of the projectile so that the initial impact forces are cushioned and can be received without breaking the nose of the projectile. However, a softened nose makes the projectile nose tend to deform (squash) on impact, which reduces sharpness and hence the cutting action (sectional density) of the projectile on impact.

In the present invention, FIG. 2, projectile 20, the monolithic high incapacitation small arms projectile, which comprises a heat treated case hardened steel core 22 of the unique shape of the projectile, with a plated on surface 21 of a rifling engagement means which is strongly adhered to the core through a plating means. This engagement surface 21 or bonded jacket can be of a metallic material or alloy such as copper, nickel, zinc, or aluminum and their alloys. The acceptable plating processes can be electroplating (U.S. Pat. Nos. 1,916,465 and 3,431,612), electroless plating or mechanical plating (U.S. Pat. No. 5,597,975) as is desired to achieve the best function and economy of production. The basic steel or other suitable material core is fabricated to the shape and dimensions to include a boat tail 26 and a cannelure groove 25 of the desired projectile while taking into consideration the jacket thickness and is produced using conventional means. The jacket or engravement surface is typically made of copper, nickel, zinc or aluminum and alloys of each, which can be accurately plated, or cladded on to the surface of the preferably steel core.

The basic steel or other suitable material core 22 is fabricated to the shape and dimensions of the desired projectile using conventional means. The core is made of a material having a high stiffness, hardness and strength and is designed to have a density of that around a medium carbon steel and also such that it can be case hardened region 23 to around 0.030 inches deep to a Rockwell hardness of C50 or greater as taught by U.S. Pat. No. 4,619,203. What is clearly not taught in U.S. Pat. No. 4,619,203 nor anywhere else in the prior art is the use of the full length core with a pointed and hardened tip as in the present invention. In the preferred embodiment of this invention the core is a medium carbon steel such as AISI 1045. In the preferred embodiment of this invention the core is a specially heat treated and case hardened medium carbon steel which is between 4.5 and 5.0 calibers long and having the ogival front end and a flat based or boat tailed but more preferably boat tailed 26 rear end. The nose of projectile of the core is of a very small radius as compared to the prior art. Contrary to the teachings of the prior art the relative sharp pointed nose 24 of the current invention is expected to react differently towards different hard targets such as steel plates and ceramic armor. When striking softer materials and thin hard materials the nose portion will remain intact and will facilitate penetration with no significant loss of mass. When however the projectile encounters either a relatively hard and thick target or a very hard target such as ceramic plates the nose will break away in a sacrificial manner leaving sharp edges to dig into metallic targets at obliquity causing them to be more probably penetrated. Whereas when the relatively sharp nose 24 encounters a ceramic target the extreme local pressure exerted by the relatively small hard point will more likely fail and fracture the ceramic than a larger nose allowing the projectile to both retain a large percentage of it's original mass while penetrating the fractured ceramic material. Thus it may be seen that the dynamic response to various types of targets is superior to the prior art in several novel and different ways. It can be seen readily that such the projectile 20 may also be constructed of other materials as is apparent that are plateable with the group consisting of Copper, Nickel, Zinc and Aluminum or their alloys.

The jacket or engravement surface 21 is preferably made of copper or nickel, though zinc or aluminum and the alloys of each that can be accurately plated on the surface of the preferably steel core may also be used. The jacket or engravement surface covers the surface of the core entirely and to a constant and controllable depth that will be sufficient to keep the hardened core from bearing on the lands of the gun barrel while engaging the rifling so as to cause the projectile to follow the rifling and rotate with the rifling. This jacket or engravement surface may be constructed of many materials such as alloys of copper, nickel, zinc or aluminum. Other materials may also be suitable for the use as the jacket or engravement surface. The copper or copper alloy, a nickel or nickel alloy, or zinc or zinc alloy or aluminum or aluminum alloy or other alloy or material plating all over the core and to a sufficient depth to prevent the hardened steel core from bearing on the rifling of the bore while providing a sufficient foundation moment for stability and accuracy and proper obturation of the gun gases.

Since this is a monolithic structure where the jacket is plated intimately surrounding the core of the projectile the jacket may be said to be connected to the core in a fully intimate manner and is generally inseparable. Alternatives will be in diameters and length relationships as well as rifling twists or resultant spin rates for a given launch velocity suitable for achieving differing degrees of stability out of various cartridges and calibers of guns such that the dynamic Sg>~1.5 or so.

The swaged or machined cannelure groove 25 is embodied to provide a secure interface with conventional cartridge cases to provide the support required to function reliably in semi-automatic and full automatic firearms. The cannelure case interface provides a consistent bullet pull and shot start, which as well established in the art contributes to even ignition and burning of the propellant at repeatable pressures reducing stress on the firearm and increasing accuracy. An aero-ballistic efficient nose 24 as provided increases the projectile's ballistic coefficient and retains velocity and energy in flight. The nose shape is not reproduced nor recommended in the swaged cored sheet metal jacked type projectiles of the prior art such as the M855 projectile. These prior art lead cored sheet metal jacked projectiles deform under the high acceleration in the gun bores collapsing outward against the bore increasing friction, raising chamber pressure, increasing wear, and using energy that is no longer available to further accelerate the projectile. The solid non-deforming core of the present projectile 20 does not expand against the bore and waste energy needed to accelerate the projectile. The resistance in bore is limited to the initial engraving of the rifling and the relatively lower sliding friction of the bearing surface moving down the bore.

Enhanced incapacitation to a novel degree is achieved by designing the monolithic bullet to be sufficiently stabilized to fly properly in the atmosphere under all conditions but to turn or yaw only 90 degrees upon entering soft tissue or a tissue simulant and remain in that orientation throughout its travel, describing a helix like track through the target. As is shown in the Fall 2001, Volume 5, Number 2 issue of the Wound Ballistics Review, Wound Profiles, pgs 25–38, this is significantly different and novel from the action of all other bullets during their transit of soft tissue and tissue simulant. The present and novel invention, is for this projectile to turn or yaw only 90 degrees and maintain that attitude in soft tissue or simulant and is due to the relationship between the Sg factor and the various mass moments of inertia which differ from jacketed lead or other similarly low Length/Diameter dense cored composite projectiles, especially those such as the M855. The limits of these relationships appear to be most operative for the projectile with an average density of 7.8 to 8.5 grams/cc, a boat tail of between 0.5 and 1.5 calibers long, an Sg of around 1.5 but less than 2.5, a length to diameter ratio of between 4.5 to 5.0 calibers and exhibiting a rigid or stiff core. It is also believed that a synergistic action exists between the rifling twist rate for the M16A2 Rifle, the M4 Carbine and the M249 SAW of one twist in 7 inches with the previously described attributes which act together to create the highly different and novel effects of the projectile when transiting 10% Ordnance Gelatin simulating soft tissue targets. It is also believed that for rifling twist rates of less than 1 in 7 that the action of the projectile is less dramatic and departs somewhat from the ideal action as one goes from the faster 1 in 7 twist to slower twists such as 1 in 8 or 1 in 9 and especially to 1 in 12 twist rates. It is also possible that one may make certain design changes to accommodate the slower twist rates to recover some of the unique action of the projectile but with some loss in very low temperature stability and possibly low temperature accuracy.

Operation

The said projectile is held in a cartridge case by the crimp in the cannelure groove provides the mechanical structure and bearing surface to feed from the magazine or ammunition belt into the chamber of the firearm. When the propellant is ignited the bullet pull resistance of the projectile held by the cannelure groove aids in the complete and consistent ignition of the propellant. Said projectile cannelure grove and taper of the ogive are such that the projectile is not initially in contact with the rifling. This arrangement prevents a spike in chamber pressure. As the expanding propellant gases push said projectile forward the plated engraving means makes contact with the rifling in the bore obturating and sealing the gun gases. The resistance to engraving provides the shot start to raise the chamber pressure smoothly to allow consistent propellant burn and a consistent velocity, lower chamber pressure, and improved accuracy. The rigid core does not distort so once the engraving of the bearing surface is complete only the sliding friction of the jacket material as modified with the dry tungsten disulfide lubrication uses energy in the propellant gas leaving the remainder to accelerate the mass of the projectile down the barrel. This results in higher velocity with lower chamber pressure and less wear on the bore. As said projectile accelerates down the bore the rifling engaged with the jacket material bonded to the core and spins the projectile to gyroscopically stabilize it for flight. The harden steel core does not ride on the rifling lands. As said projectile exits the muzzle the propellant gases flow around the smooth boat tail without the turbulence caused by flat or irregular shaped bases that degrades accuracy. The length, weight and shape of the said projectile are matched to the twist rate of the rifling to gyrostabilize the projectile in flight and minimize yaw-induced drag. The projectile shape, surface, and stabilization allow it to travel to the target with minimal loss of velocity to drag. More retained velocity translates to longer range, shorter time of flight, simpler ballistic solutions, and more energy on target.

Upon striking a personnel target the point attempts to change direction and the unique design of said projectile causes it to rapidly yaw 90 degrees with cross product of these vectors and the torque of the spinning projectile induces a flat spin. Said projectile remains at 90 degrees penetrating presenting the cross section of the side of said projectile. The orientation and flat spin cuts a helical wound track. The rigid projectile retains its shape and mass penetrating deeper and making a much larger wound cavity than prior art projectiles that only tumble (yaw) once or twice.

Upon striking a material target softer than the projectile, the hardened sharp point and high sectional density enhances penetration. The denser target limits the tendency to yaw so the projectile tends to stay point on and continue to penetrate. Once penetration is complete and the projectile is in the air it does not yaw significantly prior to striking any personnel beyond the intermediate target with increased lethal effectiveness.

Upon striking a target harder than said projectile the sharp hardened point causes a stress fracture in the target and the tip fractures with only slight loss of mass. The projectile nose takes the shape of a truncated cone with sharp hardened edges, a tough core, and high sectional density that continues to penetrate. Impacts at high angles of obliquity for prior art pointed steel penetrators usually result in the projectile glancing off. The present invention fractures at the point creating a flatten point that digs into the armor and keeps the sectional density behind the cutting edge and penetrating rather than glancing off. Once penetration is complete and the projectile is in the air it does not yaw significantly prior to strike a personnel beyond with increased lethal effectiveness.

CONCLUSION, RAMIFICATIONS, SCOPE

In the prior art attempts to increase penetration have most often resulted in tradeoffs of less accuracy and lethality. Attempts at increasing lethality have most often resulted in less penetration. Attempts at increased accuracy have usually resulted in less penetration and lethality. The present invention enhances all three of these critical measures of effectiveness for military small arms ammunition.

The US Army's Advanced Combat Rifle Studies estimated the effect on the ratio of friendly to enemy casualties produced by an increase in our weapons probability of hit and probability of incapacitation given a hit. The study indicated a shift of 50% of the increase in probability of hit and 30% of the probability of incapacitation given a hit. The improve accuracy of the present invention will correspondingly increase the probability of hit against point targets. The present invention's deep penetration and significantly increased wound cavity will increase probability of incapacitation given a hit. The present invention increased ability to penetrate concealment and light cover greatly enhances the effectiveness of suppressive fires reducing the enemy's ability to fire or maneuver effectively. The accuracy and wounding capabilities contributes not only to the probability of incapacitation but also to reduce the time to incapacitation. This is vital when confronting terrorist in suicidal attacks and hostage situations. Terrorist incidents and operations in Lebanon, Africa, Panama, and Northern Ireland have demonstrated the need for an enhanced capability against drive by, drive through and truck bomb attacks. The present invention will penetrate light vehicles and rapidly incapacitate the occupants significantly faster than prior art as represented by the NATO M855 projectile.

The present invention does not pollute the environment with toxic heavy metals in the manufacture or use. This will reduce the health hazarded associated with firing lead containing ammunition and the costs of clean up for small arms ranges.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationship for the parts of the invention, to include variations in size, materials, shape, form, function and manner of operation, assemble and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

We claim:

1. An axisymmetric projectile 20 consisting of a unitary core 22 and an encapsulating metal jacket 21; said jacket is securely bonded to said core by a process selected from the set of processes consisting of electroplating, electroless plating, and mechanical plating; said unitary core is made from case hardened steel 23; said projectile having an aft boat tail cross section 26; said projectile having a cylindrical cross section forward of said aft boat tail; said projectile having a cannelure groove 25; said projectile having an ogival cross section forward of said cannelure groove; said projectile having a sharp pointed nose 24; said projectile having an external length and an external diameter; said external length divided by said external diameter is a ratio greater than or equal to 4.5; the combination therewith of a projectile having a gyroscopic stability factor less than or equal to 2.5; the combination therewith of a projectile that does not break upon impact with external body armor and subsequent soft target penetration; the combination therewith of a projectile having a yaw-of-repose angle while penetrating soft targets substantially equal to 90 degrees for substantially more than a brief moment in time.

* * * * *